United States Patent [19]

Mize

[11] Patent Number: 4,685,760

[45] Date of Patent: Aug. 11, 1987

[54] BOOSTER HANDLE

[76] Inventor: Max D. Mize, 712 N. Springfield, Anthony, Kans. 67003

[21] Appl. No.: 831,836

[22] Filed: Feb. 24, 1986

[51] Int. Cl.[4] ..... H01R 4/40
[52] U.S. Cl. ..... 439/822; 439/829
[58] Field of Search ..... 339/255 P, 260, 261

[56] References Cited

U.S. PATENT DOCUMENTS 2,444,229 6/1948 Johnson ..... 339/255 P

*Primary Examiner*—Joseph H. McGlynn
*Attorney, Agent, or Firm*—John Wade Carpenter

[57] ABSTRACT

A battery contact clamp for use in charging storage batteries. A pair of members is pivotally secured to each other. Each member has a jaw and a plurality of teeth. A torsion spring urges the jaws together. A lug terminal is pivotally secured to one of the members to provide a connection joint for a cable.

15 Claims, 8 Drawing Figures

FIG. 3
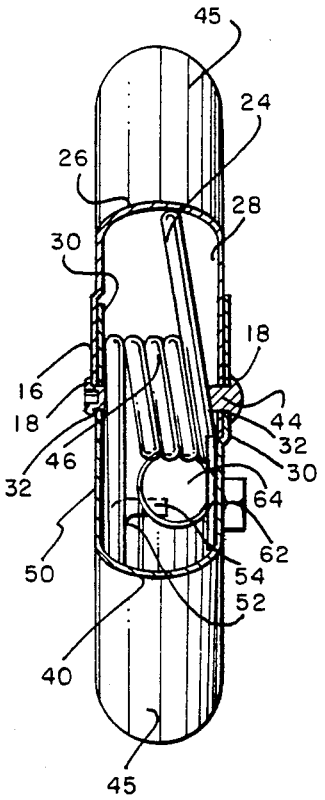
FIG. 5
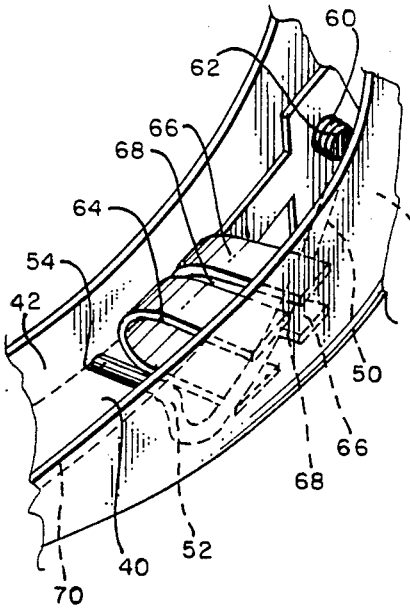
FIG. 4
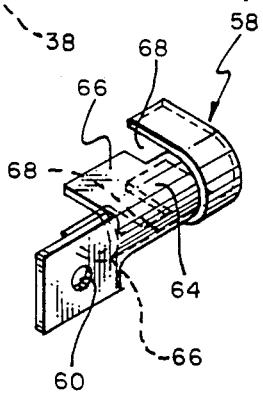
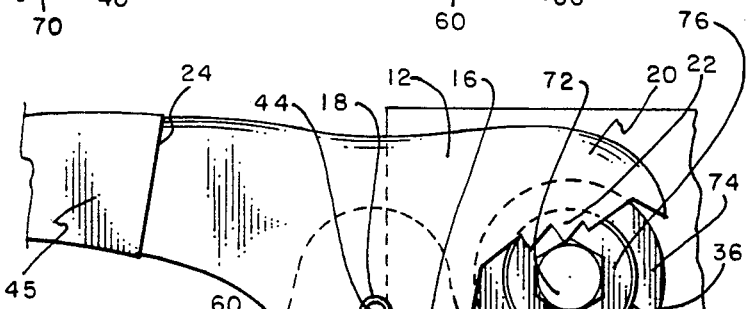
FIG. 6
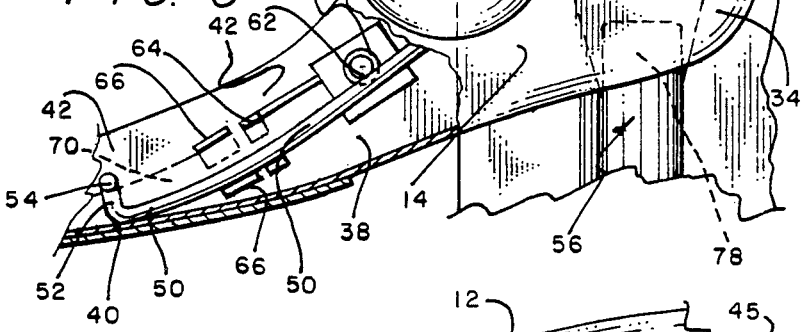
FIG. 7
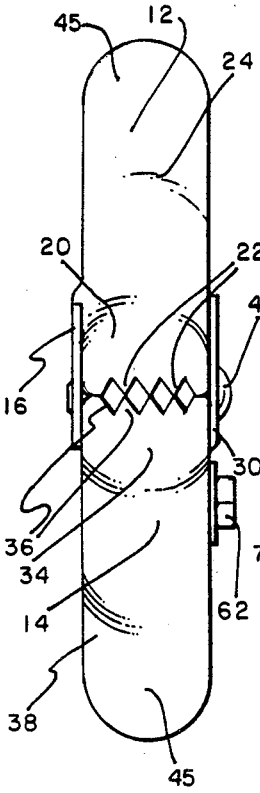
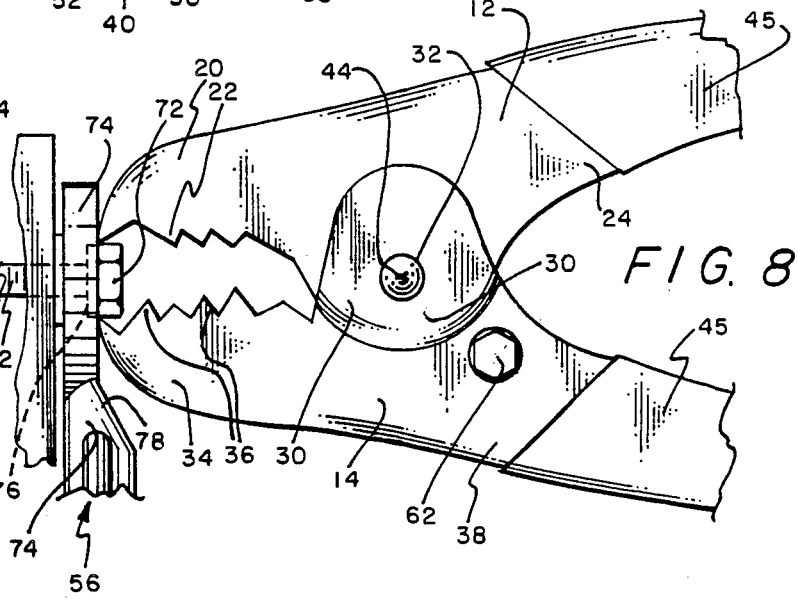
FIG. 8

BOOSTER HANDLE

BACKGROUND OF THE INVENTION

1. Field of the Invention

The invention is related to booster handles. More specifically, this invention provides a battery contact clamp for "jump starting" an automobile, charging a battery, or the like.

2. Description of the Prior Art

U.S. Pat. No. 3,737,832 to Anderson teaches an electrical clamp wherein the connecting means provided at the pivot point has shock absorbing properties and is comprised of a resilient sleeve surrounding the interconnecting rivet. The clamp of Anderson has jaws which are not in close proximity to each other when the clamp is closed. U.S. Pat. No. 3,267,452 to Wolf discloses a battery determining whether or not the clamp is being connected to the correct terminal of a battery prior to charging. The clamp of Wolf and Anderson do not have a pivotal lug terminal within a handle of the clamp which is in bias contact with an arm of the spring that urges the jaws together. None of the foregoing prior art patents teach or suggest the particular battery contact clamp of this invention.

SUMMARY OF THE INVENTION

This invention accomplishes its desired objects by broadly providing a battery contact clamp for use in charging batteries within an automobile. The clamp includes a lower member having a pair of lower parallel ears with aligned lower apertures and having one end terminating into a lower jaw portion with a structure defining a plurality of teeth. An upper member is provided having a pair of upper parallel ears with aligned upper apertures that register with the lower apertures of the lower parallel ears of the lower member when the upper parallel ears and the lower parallel ears mate, The upper member additionally has an end terminating into an upper jaw portion having a structure defining a plurality of teeth.

A rivet means passes through the lower and upper apertures to pivotally secure the lower member to the upper member such that the jaw portions of the lower and upper member cooperate with each other respectively. A torsion spring means is provided for urging the jaw portions together in a touching relationship about the rivet means and maintaining the jaw portions in a touching relationship when the clamp is in a closed posture.

The torsion spring means has convolutions that are positioned around the rivet means and an upper end and a lower end that respectively engage the upper and lower members. A lug terminal means is pivotally secured to the lower member. The lug terminal means is contacted biasingly by the lower end of the torsion spring mean to retain and urge the lug terminal means against the lower member and assist in retaining any cable engaged to the lug terminal means against the lower member.

The present invention also accomplishes its desired objects by providing a method for connecting a battery contact clamp to a side-mount battery terminal comprising the steps of:

(a) grasping the pair of handles of the clamp which are riveted pivotally together and such has a U-shaped configuration and includes a jaw having a plurality of teeth formed and structured along a pair of sides and the front of the respective jaw, the teeth of the jaws of the handles being in a touching, occlusive relationship when the clamp is in a closed posture and urged biasingly together by a torsion spring means that convolutes the rivet and includes a pair of spring arms that extend from the convolutions of the spring into the U-shaped handles with one of the spring arms having a lip and contacting biasingly a lug terminal pivotally secured within one of the U-shaped handles to urge and hold the lug terminal within and against the inside of the U-shaped handle and protect the user from accidentally contacting any cable secured to the lug terminal;

(b) forcing the jaws of the handles apart by pressing the handles against the spring arms of the torsion spring;

(c) positioning the open jaws of step (b) around a countersunk battery bolt within a side-mount battery terminal of a sidemount battery; and (d) releasing the pressure off the handles such that the jaws of the handles close around the counter-sunk battery bolt.

It is an object of the invention to provide a novel battery contact clamp.

Still further objects of the invention reside in the provisions of a method for connecting a battery contact clamp to a counter-sunk battery bolt within a side-mount battery terminal.

These, together with the various ancillary objects and features which will become apparent as the following description proceeds, are attained by this invention preferred embodiments being shown in the accompanying drawings, by way of example only, wherein:

BRIEF DESCRIPTION OF THE DRAWINGS

FIG. 3 is a vertical sectional view taken in direction of the arrows and along the plane of line 3—3 in FIG. 2;

FIG. 4 is a perspective view of the lug terminal;

FIG. 5 is a partial perspective view of the inside of a handle of the clamp having the lug terminal pivotally secured thereto;

FIG. 6 is a partial side elevational view of the clamp disclosing the lug terminal being held down biasly by a spring arm from the torsion spring;

FIG. 7 is a front elevational view of the clamp depicting the jaws having teeth in the front; and FIG. 8 is a side elevational view of the clamp engaged to a counter-sunk battery bolt of a battery terminal of a side-mount battery.

DETAILED DESCRIPTION OF THE DRAWINGS

Figure 1:
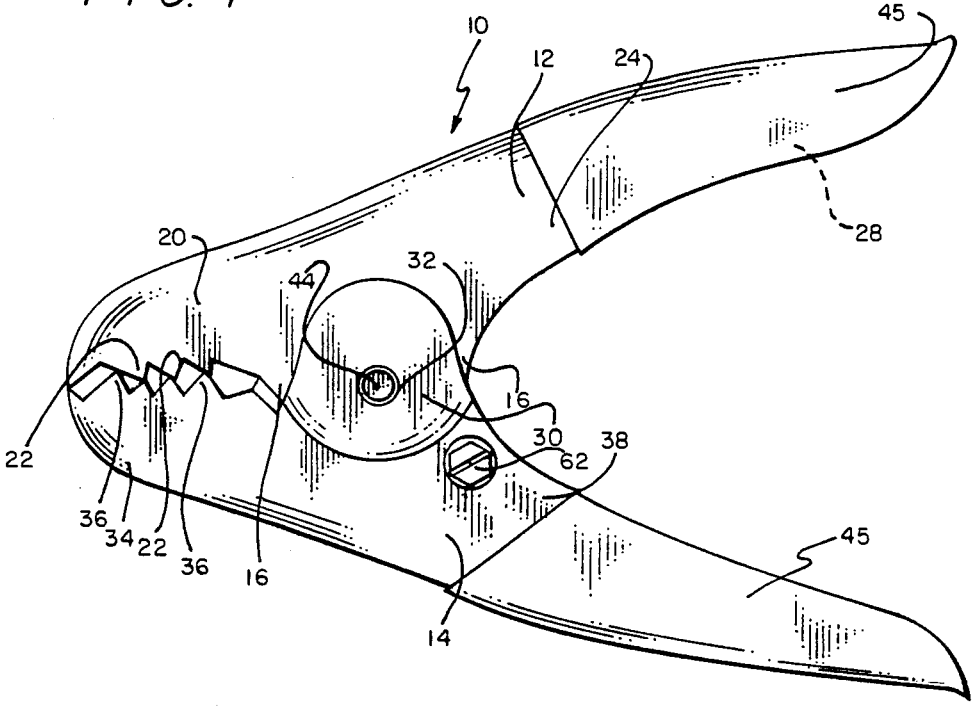
FIG. 1 is a side elevational view of the battery terminal clamp of this invention.

Referring in detail now to the drawings wherein similar parts of the invention are identified by like reference numerals, it is seen that the battery charger clamp, generally illustrated as 10, has a metallic upper member 12 and a metallic lower member 14. The upper member 12 has a pair of parallel ears 16—16 with aligned apertures 18—18. The upper member 12 also includes an arcuate nose jaw portion 20 with a plurality of teeth 22, and a handle 24 having a U-shaped configuration with a base 26 and a pair of parallel walls 28—28 integrally bound to the base 26. The lower member 14 has a pair of parallel ears 30—30 with aligned apertures 32—32 that register with the apertures 18—18 when the parallel ears 16—16 mate with the parallel ears 30—30 such that the members 12 and 14 form a cooperating relationship. The lower member 14 further has an arcuate nose jaw portion 34 with a plurality of teeth 36, and a handle 28 including a U-shaped configuration with a base 40 and a pair of parallel walls 42—42 integrally bound to the base 40. A rivet 44 passes through the two pair of apertures 18—18 and 32—32 to pivotally secure together the members 12 and 14 such that the respective jaw portions 20 and 34 cooperate with each other in an occlusive relationship. Fitted over each of the handles 24 and 38, including the respective inside walls 28—28 and 42—42 and the respective bases or inside bottoms 26 and 40, to provide shock-protection and a hand grip is a sleeve 45 constructed of an insulating material.

A wound torsion spring 46 has its convolutions disposed and about the transversed hinged rivet 44 and between the two pair of ears 16—16 and 30—30 of the respective members 12 and 14. The spring 46 has opposed spring arms 48 and 50 extending from the convolutions and engaging the handles 24 and 38 respectively. Arm 50 has an askewed end 52 with a lip 54. The spring 64 including its arms 48 and 50 tends to urge the jaws 20 and 34 together under pressure and therefore tends to urge the jaw teeth 22 and 36 of the respective jaws 20 and 34 into a biting engagement with a battery terminal, generally illustrated as 56 (see FIG. 8) when located between the jaws 20 and 34.

A metallic lug terminal, generally illustrated as 58 (see FIG. 4), has a lug aperture 60 wherethrough a screw 62 or the like, rotatably passes to pivotally secure the lug terminal 58 into the wall 42 of the handle 38. The lug terminal 58 is generally U-shaped with a lug base 64 that is part of the lug terminal 58 pivotally connected to the wall 42, and a pair of generally parallel lug walls 66—66 integrally bound to the lug base 64. Each of the lug walls 66—66 has a lug recess 68. When the lug terminal 58 is pivotally secured to the wall 42 of the handle 38, the lug walls 66—66 extend towards and into close proximity of the other wall 42 of the handle 38 (see FIG. 3) that is opposed to the wall 42 having the lug base 64 pivotally secured thereto.

The lower end of the spring arm 50 extending form the convolutions of the spring 46 contacts biasingly the lower lug wall 66 of the lug terminal 58 to retain and urge the lower lug wall 66 against the inside bottom or base 40 of the U-shaped handle 38 of the lower member 14. Any cable 70 (indicated by dotted lines in FIG. 5 and 6 engaged within the U-shaped confines of the lug terminal 58 is passed under the lip 54 of the askewed end 52 of the spring arm 50.

The combination of the spring arm 50 biasingly contacting the lower lug wall 66 to hold the latter against the inside bottom 40 of the U-shaped handle 38, along with the passing of the cable 70 underneath the lip 54 of the askewed end 52 of the spring arm 50, retains and maintains the cable 70 within the U-shaped configuration of the handle 38 of the lower member 14 to protect the user of the battery charger clamp 10. Also aiding the retention of the cable 70 within U-shaped handle 38 and protecting the user of the clamp 10 is the pivotally connecting of the lug base 64 to the wall 42 of the handle 38 such that the lug walls 66—66 extend outwardly towards and to be in close proximity with (see FIG. 3) the other wall 42 of the handle 38 that is opposed to the wall 42 having the lug base 64 pivotally secured thereto.

With this feature of the invention, the end of the cable 70 can not slip directly, outwardly or perpendicularly away from the lug base 64 of the lug terminal 58 because the end of the cable 70 is essentially enclosed within the internal confines of the U-shaped lug terminal 58 by the close proximity of the wall 42 (not having the lug base 64 pivotally secured thereto) to the end of the lug walls 66—66.

Another important feature of this invention is the fact that the spring 46 with its spring arms 48 and 50 extending substantially along the insides of the U-shaped configuration handles 24 and 38 maintain and keep the teeth 22 and 36 of the respective jaw portions 20 and 34 of the respective members 12 and 14 in a touching, contact and occlusive relationship when the battery terminal 56 is not disposed between the jaws 20 and 34. This feature of the invention, along with constructing the nose of the jaw portions 20 and 34 to be arcuate, enables the battery contact clamp 10 of this invention to easily grasp the end of a side-mount battery cable that mountes to the terminals of a side-mount battery, defined as a battery mounting to a side of an internal wall underneath the hood of an automobile.

Figure 2:
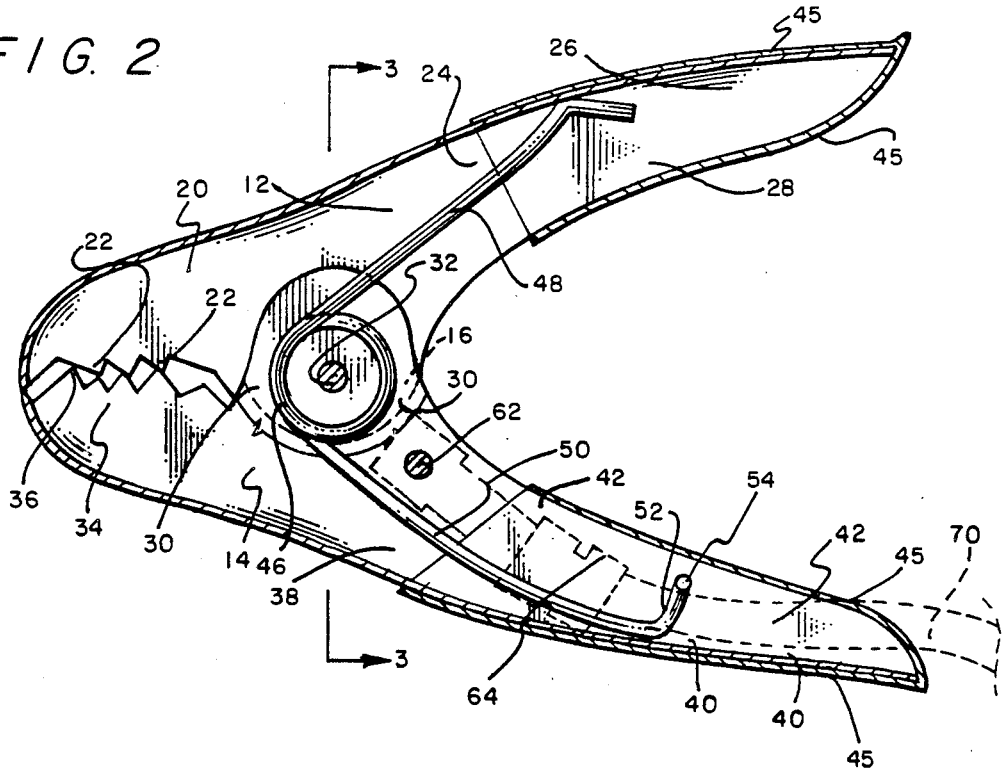
FIG. 2 is a vertical sectional view of the clamp disclosing the torsion spring and the back of the lug terminal which is held down from a biasing spring arm of the torsion spring arm.

FIG. 8 illustates the battery clamp 10 of this invention mounted to battery bolt 72 of side-mount battery terminal 74 which is connected to an end of a side-mount battery cable (not shown in the drawings) extending from a side-mount battery (also not shown in the drawings). As can be seen in FIG. 8, the battery bolt 72 (when connected to a side-mount battery) is countersunk into a terminal recess 76 of the terminal 74, which also includes a flared section 78 that flares or diverges away a section of the terminal 74. The arcuate shape of the nose or jaw portions 20 and 34, in combination with the teeth 22 and 36 of the jaw portions 20 and 34 being in a touching and occlusive relationship when not expanded by a battery terminal, enables the battery clamp 10 of this invention (see FIGS. 1, 2, 6 or 8) to grasp the countersunk battery bolt 72 either with the front portions (see FIG. 7) or the side portions of the teeth 22 and 36 of the respective jaws 20 and 34 without being restricted by the flared section 78. The counter-sunk battery bolt 72 has very little external surface area available for grasping and the battery charger clamp 10 of this invention with the plurality of teeth 22 and 36 extending around the front of the respective jaw portions 20 and 34 (see FIG. 7), and around the sides of the same (see FIGS. 1, 2 6 or 8) in the contact, occlusive relationship offers the user of the clamp 10 the feature of being able to grasp the counter-sunk battery bolt 72 with the front portions of the teeth 22 and 36 (as seen in FIG. 7) or with the side portions of the same (as seen in FIGS. 1, 2, 6 or 8).

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A battery contact clamp for use in charging batteries within an automobile comprising a lower member having a pair of lower parallel ears with aligned lower apertures and having one end terminating into a lower jaw portion having a structure defining a plurality of teeth;

an upper member having a pair of upper parallel ears with aligned upper apertures that register with the lower apertures of said lower parallel ears of said lower member when said upper parallel ears and said lower parallel ears mate, said upper member additionally having an end terminating into an upper jaw portion having a structure defining a plurality of teeth;

a rivet means passing through said lower and upper apertures pivotally securing said lower member to said upper member such that the jaw portions of the lower and upper member cooperate with each other respectively;

torsion spring means for urging said jaw portions together in a touching relationship about said rivet means and maintaining said jaw portions in a touching relationship when said clamp is in a closed posture, said torsion spring means having convolutions that are postioned around the rivet means and an upper end and a lower end that respectively engage the upper and lower members, said upper end and said lower end of said torsion spring means extend away from said rivet means in the same direction and in an opposed relationship with respect to each other.

a lug terminal means pivotally secured to said lower member, said lug terminal means being contacted biasing by said lower end of said torsion spring means to retain and urge said lug terminal engaged to the lug terminal means against the lower member.

2. The battery contact clamp of claim 1 wherein said lower end of said torsion spring means additionally comprises a structure defining a protruding lip that lodges over any cable engaged to the lug terminal means in order to additionally assist in retaining said any cable against the lower member, said lower and contacts said lug terminal means between the convolutions and the protruding lip.

3. The battery contact clamp of claim 2 wherein said lug terminal is generally U-shaped with a lug base and a pair of generally parallel walls integrally bound to said lug base, said lower end of said torsion spring means contacts biasingly one of said lug walls between the convolutions and the protruding lip.

4. The battery contact clamp of claim 2 wherein said lower end and said upper end of said torsion spring means extend towards rear ends of the lower handle and the upper handle.

5. The battery contact clamp of claim 2 wherein said lower member includes a lower handle having a U-shaped configuration with a pair of parallel handle walls and inside bottom.

6. The battery contact clamp of claim 5 wherein said lug terminal is generally U-shaped with a lug base and a pair of generally parallel walls integrally bound to said lug base.

7. The battery contact clamp of claim 6 wherein said lug base is pivotally secured to one of said handle walls of said lower member such that said lug walls extend towards the handle wall, opposed to the handle wall having said lug base pivotally secured thereto.

8. The battery contact clamp of claim 7 wherein said lower end of said torsion spring means contacts biasingly one of said lug walls to retain and urge the same against the inside bottom of said U-shaped lower handle of said lower member.

9. The battery contact clamp of claim 8 wherein each of said lug walls has a lug recess.

10. The battery contact clamp of claim 9 wherein said upper member includes an upper handle having a U-shaped configuration with a pair of parallel handle walls and inside bottom.

11. The battery contact clamp of claim 10 additionally comprising an insulation means bound entirely around said lower and upper handle including the respective inside walls and respective inside bottom of each of the lower and upper handle.

12. The battery contact clamp of claim 11 wherein said lower end and said upper end of said torsion spring means extend towards rear ends of the lower handle and the upper handle.

13. A method for connecting a battery contact clamp to a side-mount battery terminal comprising the steps of:

(a) grasping the pair of handles of said battery contact clamp which are riveted pivotally together and such has a U-shaped configuration and includes a jaw having a plurality of teeth formed and structured along a pair of sides and the front of the respective jaw, said teeth of said jaws of said handles being in a touching, occlusive relationship when said clamp is in a closed posture and urged biasingly together by a torsion spring means that convolutes the rivet and includes a pair of spring arms that extend from the convolutions of the spring in the same direction in an opposed relationship with respect to each other and into the U-shaped handles with one of the spring arms having a lip and contacting biasingly between the convolutions and the lip a lug terminal pivotally secured within one of the U-shaped handles to urge and hold the lug terminal within and against the inside of the U-shaped handle and protect the user from accidentally contacting any cable secured to the lug terminal;

(b) forcing the jaws of the handles apart by pressuring the handles against the spring arms of the torsion spring;

(c) positioning the open jaws of step (b) around a counter-sunk battery bolt within a side-mount battery terminal of a side-mount battery; and (d) releasing the pressure off the handles such that the jaws of the handles close around the counter-sunk battery bolt.

14. The method of claim 13 additionally comprising passing a cable connected to the lug terminal underneath aid lip of said spring arm.

15. The method of claim 10 or 14 wherein said releasing step (d) includes the side teeth of the jaws of the handles closing around the counter-sunk battery bolt.

* * * * *